US008105027B2

(12) United States Patent
Horng et al.

(10) Patent No.: US 8,105,027 B2
(45) Date of Patent: Jan. 31, 2012

(54) HOUSING FOR AXIAL-FLOW FAN

(75) Inventors: Alex Horng, Kaohsiung (TW); Ching-Sheng Horng, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 434 days.

(21) Appl. No.: 12/414,793

(22) Filed: Mar. 31, 2009

(65) Prior Publication Data

US 2010/0247307 A1 Sep. 30, 2010

(51) Int. Cl.
*F03B 1/00* (2006.01)
*F03B 11/02* (2006.01)
*F03D 5/00* (2006.01)

(52) U.S. Cl. ..... 415/208.2; 415/129; 415/220; 416/189; 416/247 R

(58) Field of Classification Search ..... 415/112, 415/129, 130, 131, 208.2, 228, 220; 416/189, 416/247 R
See application file for complete search history.

(56) References Cited

U.S. PATENT DOCUMENTS

| | | | | |
|---|---|---|---|---|
| 4,871,294 | A | 10/1989 | Ivanov et al. | |
| 6,142,733 | A * | 11/2000 | Alizadeh et al. | 415/208.2 |
| 7,094,028 | B2 * | 8/2006 | Chang et al. | 415/211.2 |
| 7,329,091 | B2 * | 2/2008 | Yan et al. | 415/191 |
| 7,445,423 | B2 * | 11/2008 | Ishihara et al. | 415/61 |

FOREIGN PATENT DOCUMENTS

| | | |
|---|---|---|
| TW | M488497 | 5/2002 |
| TW | M287387 | 2/2006 |
| TW | I276743 | 3/2007 |

* cited by examiner

*Primary Examiner* — David Nhu
(74) *Attorney, Agent, or Firm* — Alan Kamrath; Kamrath IP Lawfirm, PA

(57) ABSTRACT

A housing for an axial-flow fan includes a frame, a seat and a plurality of stationary blades. The frame has an air inlet and an air outlet. The seat is received in the frame and at a position where the air outlet is formed. Two ends of each stationary blade are respectively fixed to an outer periphery of the seat and an inner periphery of the frame. Furthermore, extending directions of any two adjacent stationary blades jointly define an included angle, and all of the included angles formed by all of the stationary blades are of more than two values in degrees, so that the stationary blades are not spaced with equal intervals. Consequently, while sucked air passes by the stationary blades, noises with the same tone can be suppressed effectively.

5 Claims, 6 Drawing Sheets

HOUSING FOR AXIAL-FLOW FAN

BACKGROUND OF THE INVENTION

1. Field of the Invention

The present invention relates to a fan housing and, more particularly, to a housing for an axial-flow fan including stationary blades.

2. Description of the Related Art

Currently, most impellers for heat-dissipating fans on the market include plural rotary blades evenly spaced around hubs of the impellers. Since the rotary blades of an impeller are spaced with equal intervals, angles between radially extending directions of any two adjacent rotary blades are identical. Thus, while the impeller is turning, a pure-tone noise is easily arisen and then transmitted in the air.

In order to solve the problem mentioned above, Taiwan Patent Application No. 97132907 entitled "HEAT-DISSIPATING FAN" discloses an impeller with various angles between any two adjacent rotary blades. When air flows are discharged from the impeller, noises with the same tone are not easily arisen, which leads to a decrease in the intensity of pure-tone noise. However, owing to the situation of different angles between any two adjacent rotary blades, which leads to a structural imbalance, the difficulty of a rotation-balance adjustment therefore increases. Also, it is necessary to correct the pitch or yaw of each rotary blade or to conduct dynamic balancing test, and, thus, cost is increased for the need of extra manpower. Besides, a conventional housing for an axial-flow fan commonly has a plurality of stationary blades, but manufacturers haven't known how to minimize pure-tone noise by different designs of the stationary blades.

Taiwan Patent Issue No. 488497 entitled "PRESSURE-INCREASING AND AIR-GUIDING FOR FAN" discloses a fan housing with stationary blades and is shown in FIG. 1. Referring to FIG. 1, a conventional fan housing 90 includes a frame 91, a base 92 received in the frame 91 and for an impeller 93 to be mounted on, and an air-guiding unit 94 constructed by plural stationary blades 941, The stationary blades 941 are fixed between the base 92 and the frame 91. By the arrangement of the stationary blades 941 radially attaching to the base 92, the stationary blades 941 are able to guide airflow generated from rotation of the impeller 93 to enhance air pressure.

Although the air pressure can be enhanced by the stationary blades 941, noises with the same tone forming pure-tone noise will arise due to the stationary blades 941 being spaced with identical intervals and identical angles between any two adjacent stationary blades 941. Hence, there is a need for an improvement over the conventional fan housing 90.

Moreover, Taiwan Patent Issue No. I276743 entitled "FAN AND FAN HOUSING WITH AIR-GUIDING STATIC BLADES" discloses a fan housing including a frame and plural stationary blades spaced evenly. Furthermore, an airflow-guiding element that is wing-shaped is arranged between any two adjacent stationary blades and formed on an inner periphery of the frame. Thus, with the arrangement of the airflow-guiding elements disposed beside the stationary blades, turbulence is restrained on the surfaces of the stationary blades to reduce noise arising from the turbulence. However, owing to the airflow-guiding elements extending from the inner periphery of the frame, difficulty in forming the fan housing is caused, and manufacturing cost is increased.

Additionally, Taiwan Patent Issue No. M287387 entitled "FAN AND FAN HOUSING WITH AIR-GUIDING STATIC BLADES" discloses a fan housing including a frame and plural stationary blades fixed and spaced evenly inside the frame. At least one airflow-guiding element is mounted on each stationary blade and along the circumference of the stationary blade. Thus, when an impeller in the fan housing rotates to generate airflow, the airflow-guiding elements can guide the airflow to restrain turbulence on the stationary blades from arising noise. However, difficulty in forming the fan housing and increased manufacturing cost will result from each stationary blade having at least one airflow-guiding element extending thereon.

As has been discussed above, since rotary blades of an impeller are spaced evenly and angles between any two adjacent rotary blades are the same, pure-tone noise easily arises while the impeller is turning. Although the above conventional impeller disclosing different angles between any two adjacent rotary blades overcomes the problem of pure-tone noise, difficulty in correcting the pitch or yaw of each rotary blade and dynamic balance of the impeller results in a wobbling impeller, and, then, related components will be damaged after a long-term operation. Besides, an impeller commonly mounted in the conventional fan housing has a plurality of stationary blades spaced evenly, but nobody has modified the structure of the stationary blades to overcome the problem of pure-tone noise. Hence, there is a need for an improvement over the conventional fan housing.

SUMMARY OF THE INVENTION

It is therefore the primary objective of this invention to provide a housing for an axial-flow fan including plural stationary blades that are not spaced at the same distance from each other to reduce noises with the same tone.

A housing for an axial-flow fan according to the preferred teachings of the present invention includes a frame, a seat and a plurality of stationary blades. The frame has an air inlet and an air outlet. The seat is received in the frame and at a position where the air outlet is formed. Two ends of each stationary blade are respectively fixed to an outer periphery of the seat and an inner periphery of the frame. Extending directions of any two adjacent stationary blades jointly define an included angle, and all of the included angles formed by all of the stationary blades are of more than two values in degrees.

Accordingly, while an impeller mounted inside the frame sucks air in to pass by the stationary blades for heat dissipation, noises with the same tone can be suppressed to reduce the intensity of pure-tone noise effectively.

Further scope of the applicability of the present invention will become apparent from the detailed description given hereinafter. However, it should be understood that the detailed description and specific examples, while indicating preferable embodiments of the invention, are given by way of illustration only, since various modificatons will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
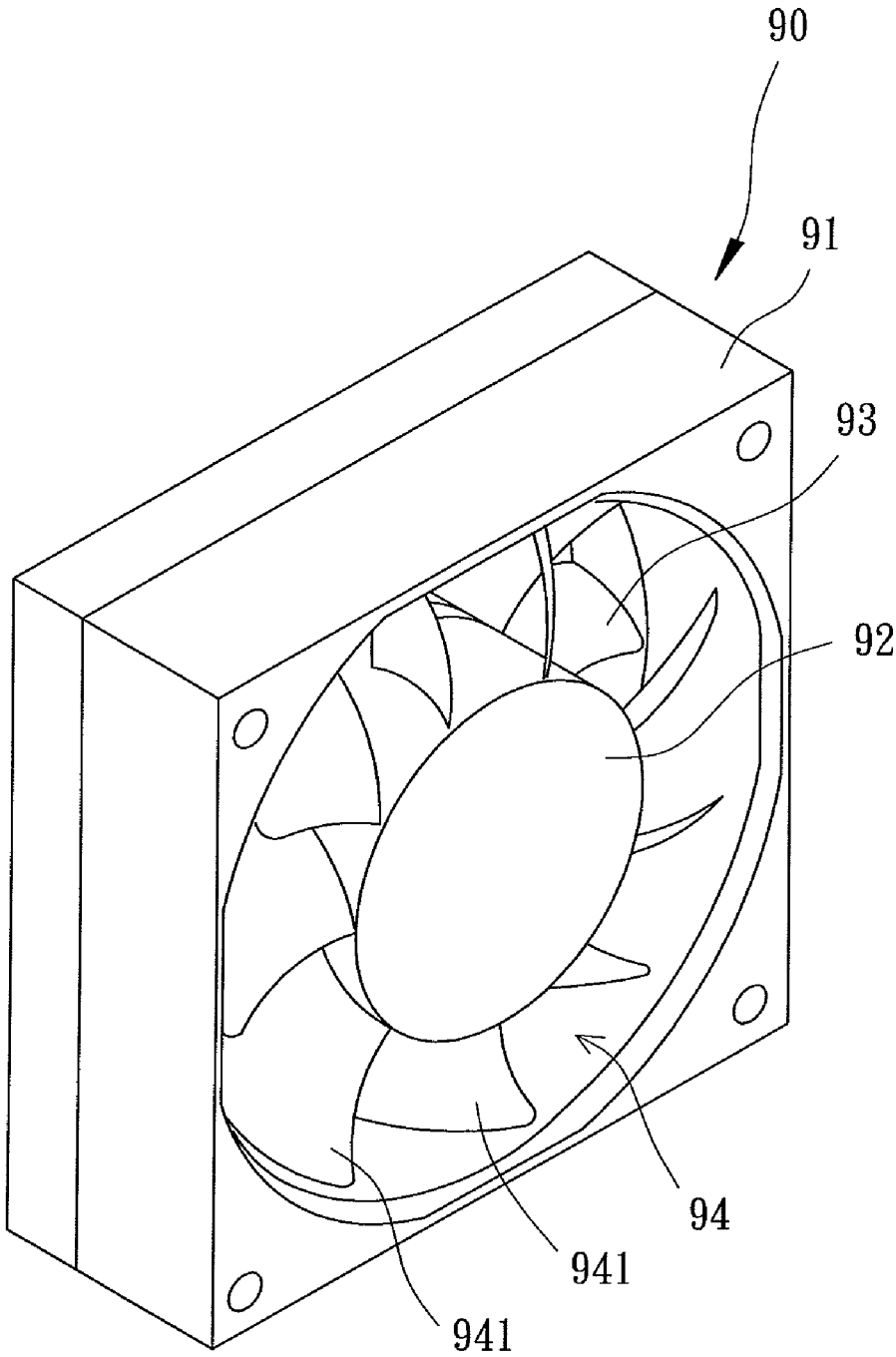
FIG. 1 PRIOR ART
FIG. 1 is a perspective view illustrating a conventional housing for an axial-flow fan.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "inner", "outer", "end", "axial", "radial", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
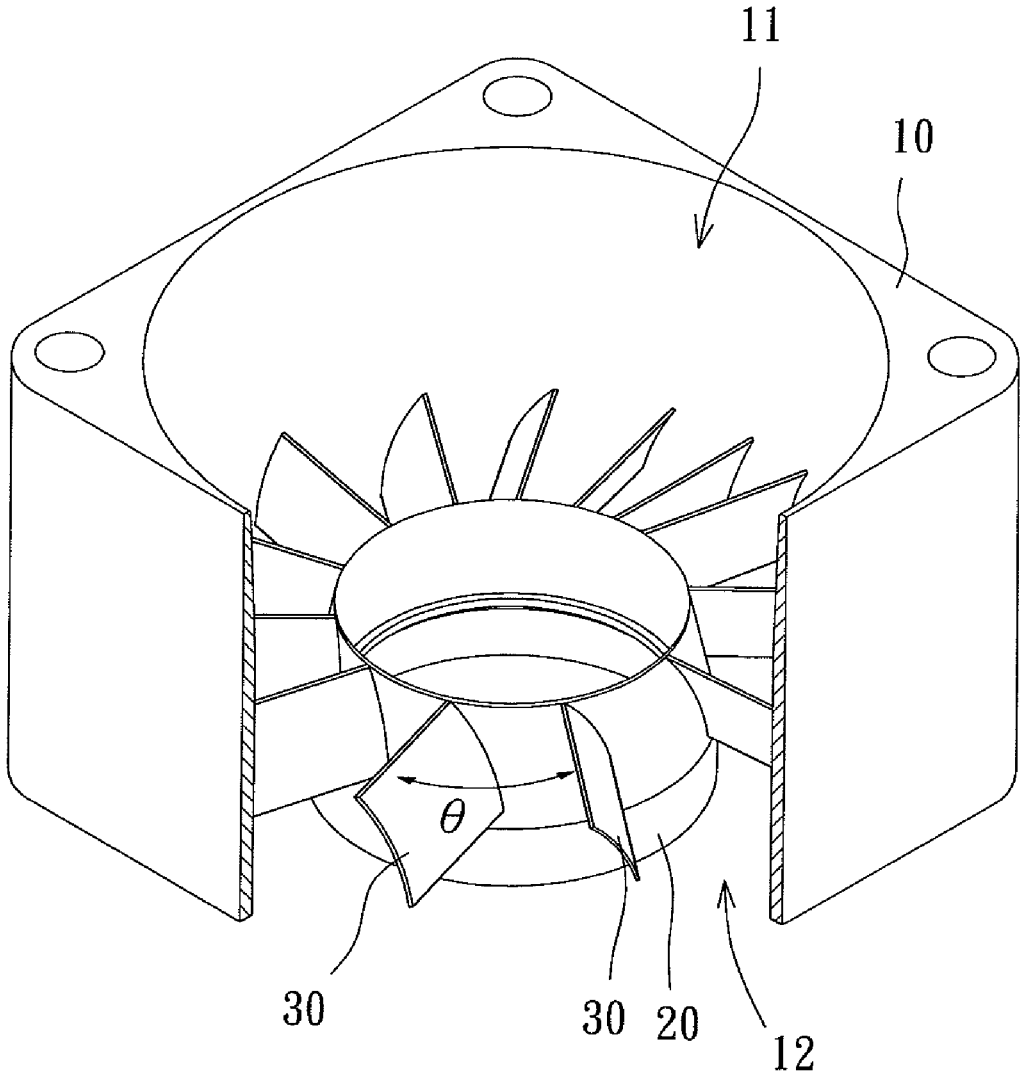
FIG. 2 is a perspective view illustrating a housing for an axial-flow fan of a first embodiment according to the preferred teachings of the present invention.
Figure 3:
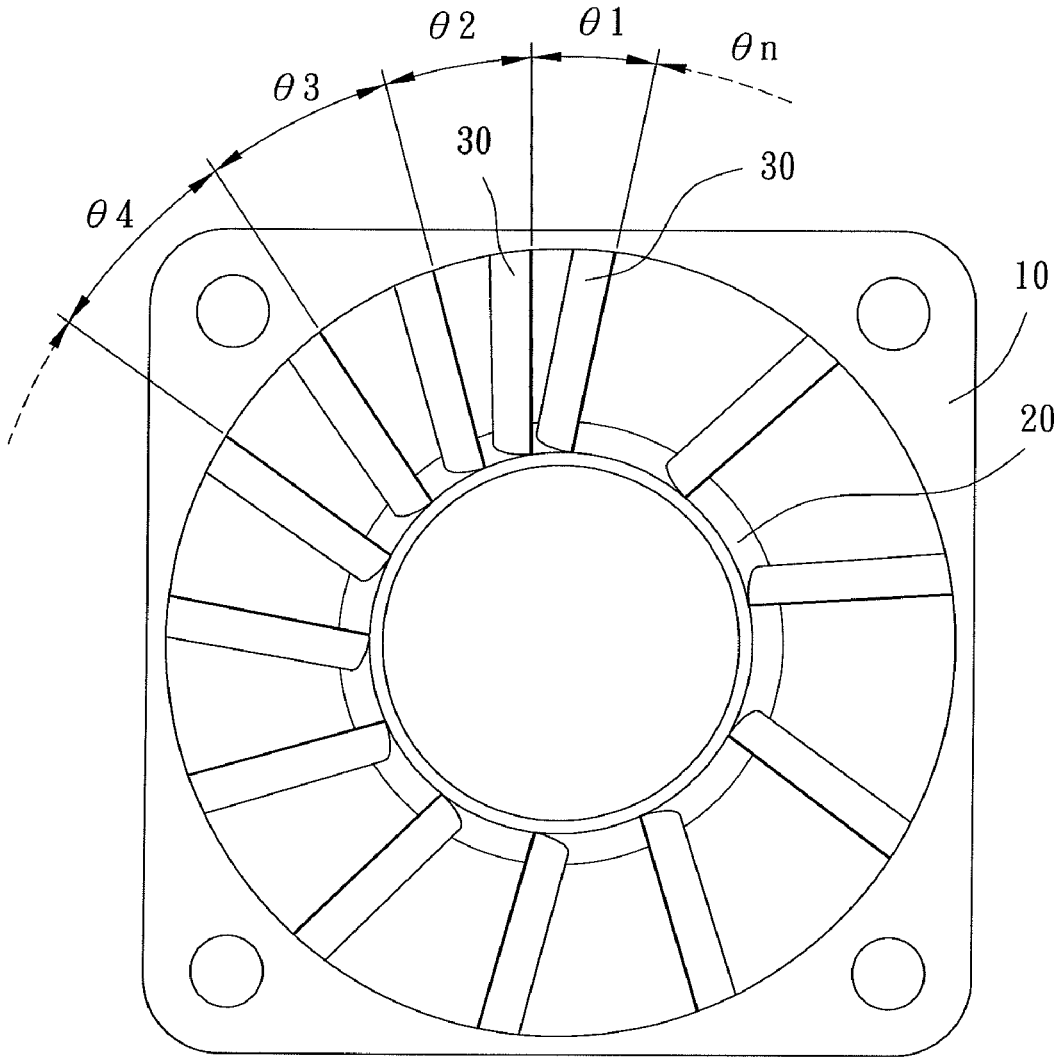
FIG. 3 is a top view illustrating the housing for an axial-flow fan of FIG. 2.

A housing for an axial-flow fan of a first embodiment according to the preferred teachings of the present invention is shown in FIGS. 2 and 3 of the drawings. According to the first embodiment form shown, the housing for an axial-flow fan includes a frame 10, a seat 20 and a plurality of stationary blades 30. Two opposite ends of the frame 10 form an air inlet 11 and an air outlet 12 respectively. The seat 20 is received in the frame 10 and at a position where the air outlet 12 is formed. Two ends of each stationary blade 30 are fixed to an outer periphery of the seat 20 and an inner periphery of the frame 10, so that the stationary blades 30 are radially arranged around the seat 20 with intervals. The housing of the present invention has all stationary blades 30 placed from each other at more than two distances on the outer periphery of the seat 20, so that extending directions of any two adjacent stationary blades 30 jointly define an included angle "θ", and the included angles "θ" are of more than two values in degrees. Preferably, for the housing of the present invention, an angle between each stationary blade 30 and a tangent plane touching the outer periphery of the seat 20 at the point where the stationary blade 30 attaches is the same.

The seat 20 of the present invention is for a stator (not illustrated) to be mounted to, and an impeller (not illustrated) rotatably couples to the stator to form an axial-flow fan. The impeller is driven by the stator to suck air in via the air inlet 11 and then output air via the air outlet 12. Thus, with the stationary blades 30 not arranged at regular intervals, noises with the same tone are suppressed, while the sucked air passes by the stationary blades 30.

Figure 4:
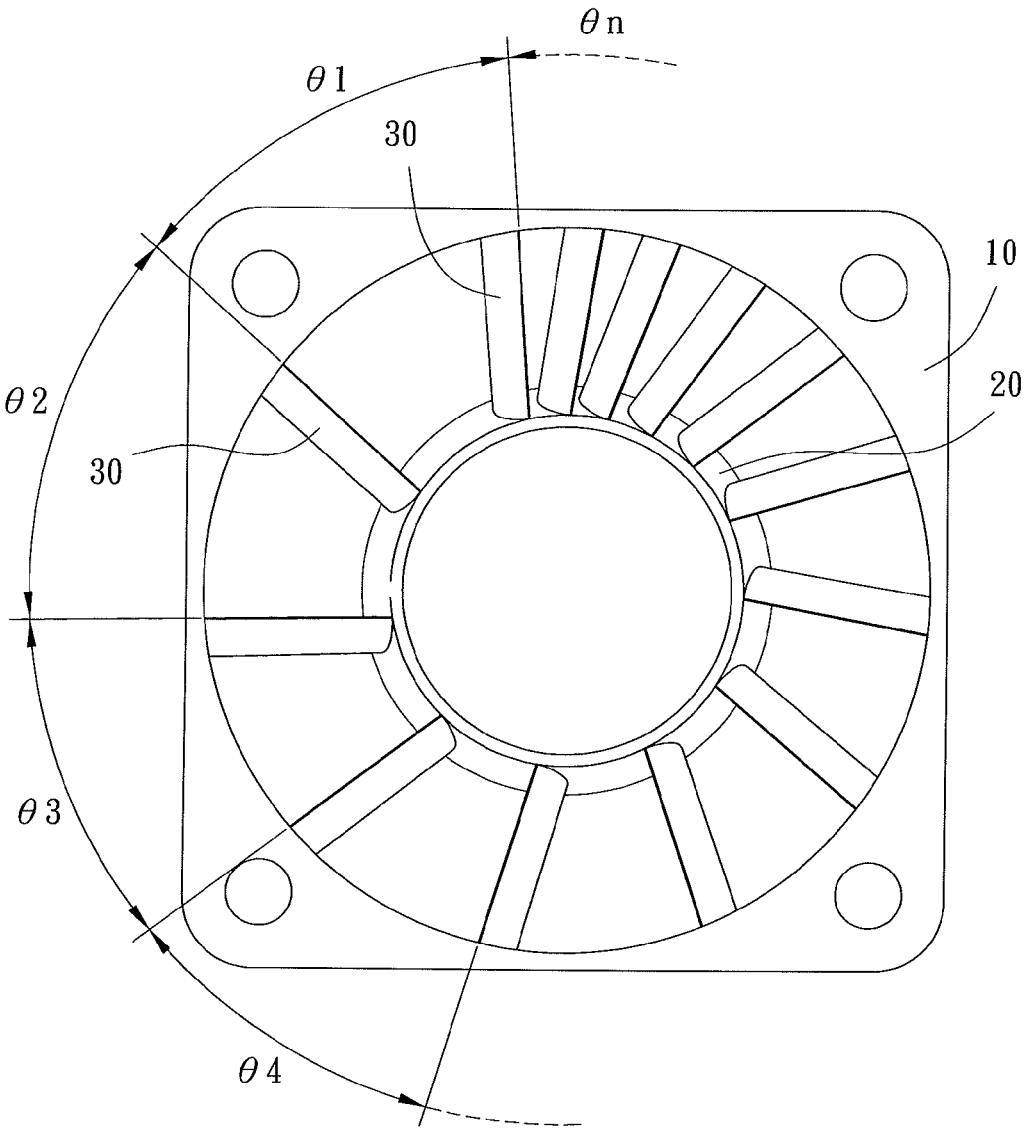
FIG. 4 is another top view illustrating the housing for an axial-flow fan modified from FIG. 2.

Referring again to FIG. 3, an amount of the stationary blades 30 of the first embodiment is "n" , and the included angles formed by any two adjacent stationary blades 30 are respectively designated as "$\theta_1$", "$\theta_2$", "$\theta_3$", "$\theta_4$", . . . and "$\theta_n$". Furthermore, in the view shown in FIGS. 3 and 4, the included angles "$\theta_1$", "$\theta_2$", "$\theta_3$", "$\theta_4$", . . . and "$\theta_n$" are sequentially arranged in the counterclockwise direction of the frame 10, with all included angles "$\theta_1$", "$\theta_2$", "$\theta_3$", "$\theta_4$", . . . and "$\theta_n$" between any two adjacent stationary blades 30 being different. Specifically, in addition to an arrangement of all the stationary blades 30 without identical intervals, values of the included angles gradually increase or decrease, that is, $\theta_1<\theta_2<\theta_3<\theta_4< \ldots <\theta_n$ as shown in FIG. 3, or alternatively $\theta_1>\theta_2>\theta_3>\theta_4> \ldots >\theta_n$ as shown in FIG. 4. Hence, the intensity of pure-tone noise created while sucked air passes by the stationary blades 30 is reduced greatly.

Figure 5:
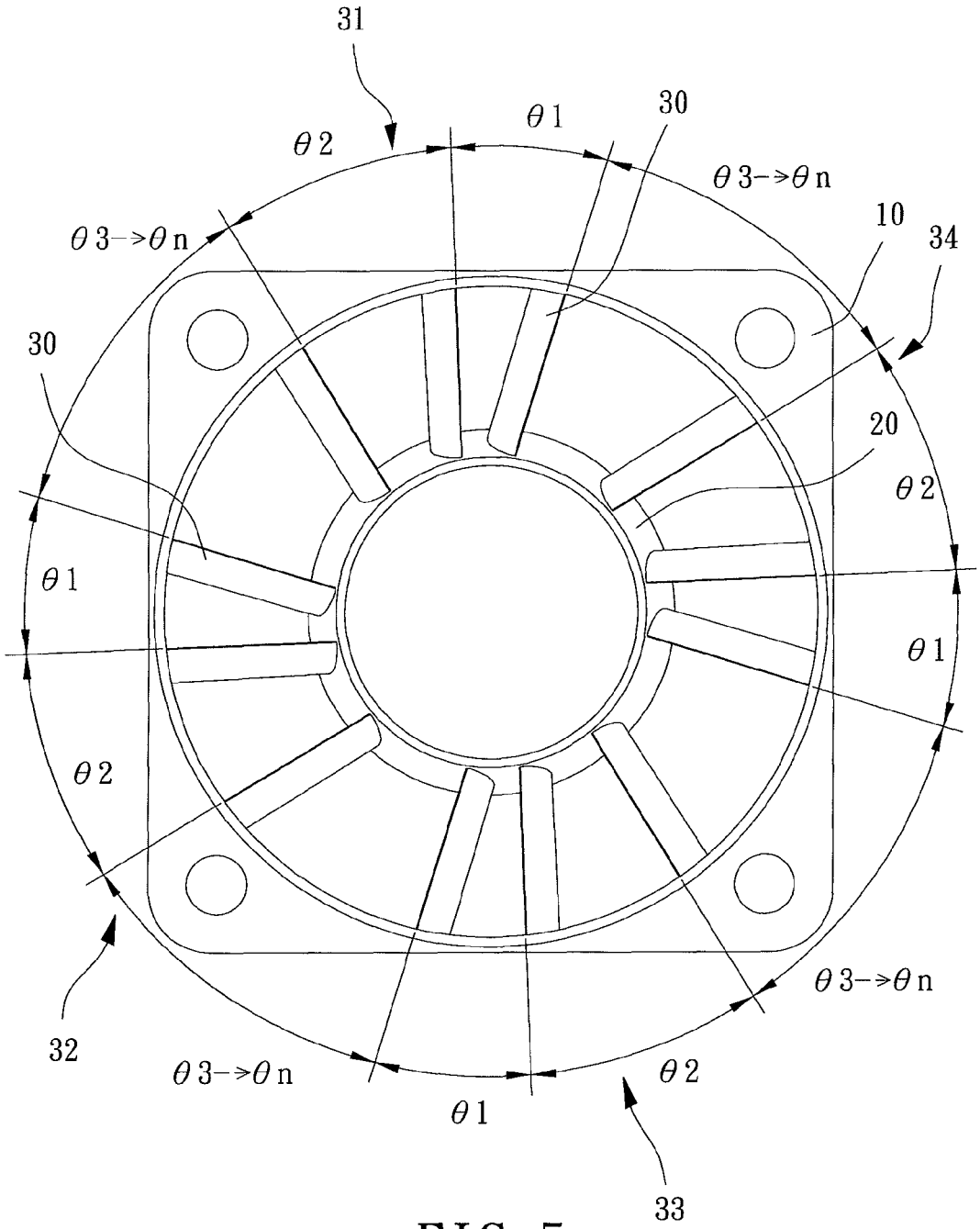
FIG. 5 is a top view illustrating a housing for an axial-flow fan of a second embodiment according to the preferred teachings of the present invention.

FIG. 5 shows a housing for an axial-flow fan of a second embodiment according to the preferred teachings of the present invention. In the preferred form shown, the included angles defined by extending directions of any two adjacent stationary blades 30 are divided into plural groups, with the included angles in each group being designated as "$\theta_1$", "$\theta_2$", "$\theta_3$", "$\theta_4$", . . . , and "$\theta_n$", with arrangements of the included angles in the groups preferably being the same. Furthermore, the included angles "$\theta_1$", "$\theta_2$", "$\theta_3$", "$\theta_4$", . . . , and "$\theta_n$" of each group are sequentially arranged in the counterclockwise direction of the frame 10, wherein values of the included angles are $\theta_1<\theta_2<\theta_3<\theta_4< \ldots <\theta_n$. In detail, the groups, which jointly contain all of the included angles, are respectively a first group 31, a second group 32, a third group 33 and a fourth group 34, and each of the groups 31, 32, 33 and 34 includes included angles "$\theta_1$", "$\theta_2$", "$\theta_3$", wherein $\theta_1<\theta_2<\theta_3$. By this arrangement of the groups 31, 32, 33 and 34, the stationary blades 30 are spaced at three different intervals to effectively reduce the intensity of pure-tone noise as well.

Figure 6:
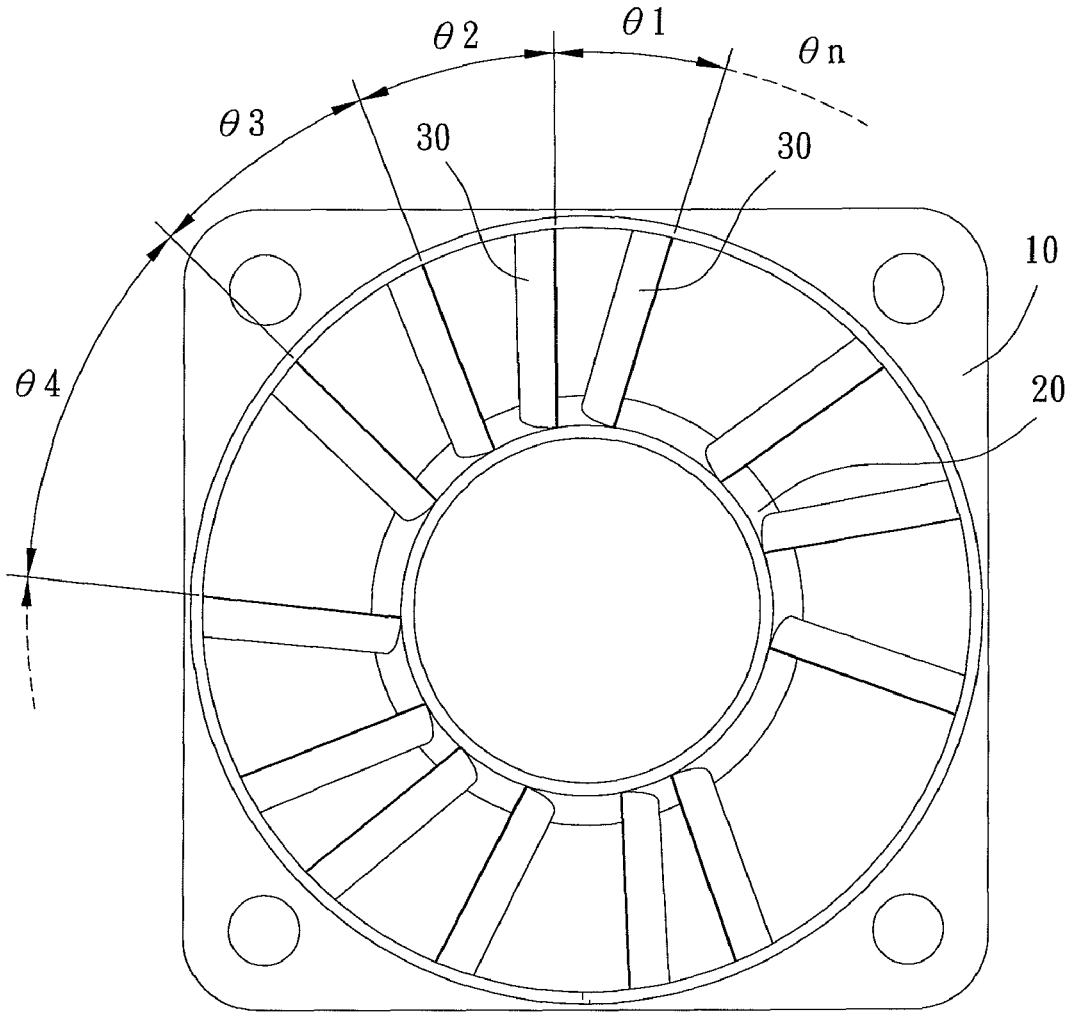
FIG. 6 is a top view a housing for an axial-flow fan of a third embodiment according to the preferred teachings of the present invention.

A housing for an axial-flow fan of a third embodiment according to the preferred teachings of the present invention is shown in FIG. 6 of the drawings. According to the third embodiment shown, an amount of the stationary blades 30 is "n" , and the included angles formed by any two adjacent stationary blades 30 are respectively designated as "$\theta_1$", "$\theta_2$", "$\theta_3$", "$\theta_4$", . . . , and "$\theta_n$". Furthermore, values of the included angles "$\theta_1$", "$\theta_2$", "$\theta_3$", "$\theta_4$", . . . , and "$\theta_n$" differ from each other, or some of them are the same. Besides, preferably, instead of gradually increasing or decreasing, the values of the included angles "$\theta_1$", "$\theta_2$", "$\theta_3$", "$\theta_4$", . . . , and "$\theta_n$" are arranged randomly. Therefore, the stationary blades 30 are arranged with irregular intervals along the outer periphery of the seat 20, so as to effectively reduce the intensity of pure-tone noise as well.

As has been discussed above, included angles between extending directions of any two adjacent stationary blades 30 have more than two values in degrees to not place the stationary blades 30 at the same distance from each other, Thus, noises with the same tone are suppressed while the rotating impeller drives the sucked air to pass by the stationary blades 30. Also, the reduced intensity of pure-tone noise improves the quality of the housing for an axial-flow fan. Consequently, it is unnecessary to vary angles between extending directions of any two adjacent rotary blades of an impeller that is received in the housing for an axial-flow fan of the present invention, and adjusting balance of the impeller is simplified to reduce cost.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A housing for an axial-flow fan comprising a frame having an air inlet and an air outlet, a seat received in the frame and at a position where the air outlet is formed, and a plurality of stationary blades, with each stationary blade having two ends respectively fixed to an outer periphery of the seat and an inner periphery of the frame, wherein extending directions of any two adjacent stationary blades jointly define an included angle, and all of the included angles formed by all of the plurality of stationary blades are of more than two values in degrees.

2. The housing for an axial-flow fan as defined in claim 1, wherein an amount of the plurality of stationary blades is "n" and the included angles formed by the any two adjacent stationary blades are "$\theta_1$", "$\theta_2$", "$\theta_3$", "$\theta_4$", . . . and "$\theta_n$", with the included angles "$\theta_1$", "$\theta_2$", "$\theta_3$", "$\theta_4$", . . . and "$\theta_n$" being sequentially arranged in a counterclockwise direction of the frame and a relationship between the included angles being $\theta_1<\theta_2<\theta_3<\theta_4< \ldots <\theta_n$.

3. The housing for an axial-flow fan as defined in claim 1, wherein an amount of the plurality of stationary blades is "n" and the included angles formed by the any two adjacent stationary blades are "$\theta_1$", "$\theta_2$", "$\theta_3$", "$\theta_4$", . . . and "$\theta_n$", with the included angles "$\theta_1$", "$\theta_2$", "$\theta_3$", "$\theta_4$", . . . and "$\theta_n$" being sequentially arranged in a counterclockwise direction of the frame and a relationship between the included angles being $\theta_1>\theta_2>\theta_3>\theta_4> \ldots >\theta_n$.

4. The housing for an axial-flow fan as defined in claim 1, wherein the included angles defined by the extending directions of the any two adjacent stationary blades are divided into plural groups, and wherein the included angles in each group are "$\theta_1$", "$\theta_2$", "$\theta_3$", "$\theta_4$", . . . , and "$\theta_n$", with the included angles "$\theta_1$", "$\theta_2$", "$\theta_3$", "$\theta_4$", . . . , and "$\theta_n$" of each group being sequentially arranged in a counterclockwise direction of the frame and a relationship between the included angles being $\theta_1<\theta_2<\theta_3<\theta_4< \ldots <\theta_n$.

5. The housing for an axial-flow fan as defined in claim 1, wherein an amount of the plurality of stationary blades is "n" and the included angles formed by the any two adjacent stationary blades are "$\theta_1$", "$\theta_2$", "$\theta_3$", "$\theta_4$", . . . and "$\theta_n$", with some or none of the values of the included angles "$\theta_1$", "$\theta_2$", "$\theta_3$", "$\theta_4$", . . . , and "$\theta_n$" being the same, with the values of the included angles "$\theta_1$", "$\theta_2$", "$\theta_3$", "$\theta_4$", . . . , and "$\theta_n$" being arranged randomly.

* * * * *